United States Patent [19]

Gaiti et al.

[11] Patent Number: 4,679,270

[45] Date of Patent: Jul. 14, 1987

[54] WASH BRUSH OPERATED BY THE WASH WATER

[75] Inventors: Giorgio Gaiti, Correggio Emilia; Loris Ferrari, Carpi, both of Italy

[73] Assignee: G.F. S.r.l., Correggio Emilia, Italy

[21] Appl. No.: 821,338

[22] Filed: Jan. 22, 1986

[30] Foreign Application Priority Data

Mar. 1, 1985 [IT] Italy ..... 46818 A/85

[51] Int. Cl.[4] ..... A46B 13/06

[52] U.S. Cl. ..... 15/29

[58] Field of Search ..... 15/24, 28, 29; 128/56, 128/66

[56] References Cited

U.S. PATENT DOCUMENTS 2,540,240 2/1951 Boyle ..... 15/29

FOREIGN PATENT DOCUMENTS 1021147 12/1957 Fed. Rep. of Germany ..... 15/29

2555951 6/1985 France ..... 15/29

*Primary Examiner*—Edward L. Roberts

*Attorney, Agent, or Firm*—Brisebois & Kruger

[57] ABSTRACT

The wash brush comprises a pan-shaped casing (1) provided with a tangential water nozzle (18), a coaxial bladed impeller (14, 16), and two concentric brushes (3, 4) of which the outer one (3) is fixed and the other (4) rotates, the impeller (14, 16) being mounted idly on the shaft (10) of the rotating brush (4) and being of cup shape to form a seat which faces the roof of the casing (1) and contains an idle double reduction gear (23) in the form of two ring gears of different diameter which engage with toothing (27) provided on the hub (13) of the impeller (14, 16) and with a gear wheel (22) keyed on to the shaft (10) of the rotating brush (4).

4 Claims, 2 Drawing Figures

WASH BRUSH OPERATED BY THE WASH WATER

This invention relates to improvements in water-operated wash brushes such as that described in Italian patent application No. 46861A/82 filed in the name of the present applicants.

Said document describes a water-operated wash brush suitable for cleaning walls, floors, metal plates, mechanical workpieces and vehicles in general, and comprising a casing into which there converges a water nozzle disposed tangentially to a bucket wheel, this latter being keyed on to the shaft of a rotating cup-shaped brush surrounded by a fixed cup-shaped brush, means being provided on the casing and on the two brushes for facilitating water discharge from the bucket wheel.

Reference should be made to the text of aforesaid document for further constructional details.

Essentially, in the aforesaid and in other similar water-operated wash brushes, the rotating brush is made to rotate at high speed as it is directly keyed on to the shaft of the bucket wheel, but in spite of this during the washing operations it is extremely easy for the rotating brush to stop when it encounters edges and/or protuberances or when it is pressed even with small force against the surfaces to be washed.

This is because although the said direct keying gives the brush high rotational speed, it is not able to transmit a torque sufficient to overcome even the small resistance offered by an irregular surface.

For these reasons the rotating brush is easily stopped as stated, and the washing operations become excessively slow and fatiguing because of the need to constantly control the pressure by which it is held against the surface to be washed.

The main object of the present invention is to provide and protect a water-operated wash brush in which the rotating brush has a torque sufficient to overcome the usual resistant forces encountered during such uses, and is thus able to obviate the aforesaid drawback, while being of simple structural design and minimum overall size.

According to the invention, this is attained in a water-operated wash brush of the aforesaid type by providing a bladed impeller which is rotatably mounted on the shaft to which the rotating brush is keyed, and which is shaped in the manner of a cup so that in combination with the casing it defines a compartment situated outside the path followed by the wash water, and containing a gear train for reducing the output rotational speed of the impeller.

In particular, according to the invention the bladed impeller has its cavity facing the casing roof, said impeller being provided, on the opposite side to that occupied by the rotating brush, with an upper circumferential cantilever ledge either integral or rigid with the blading of said impeller.

The impeller is rotatably mounted on the shaft of the rotating brush, and on its hub comprises toothing which engages with an idle double gear, which itself engages with a gear wheel provided on the shaft of the rotating brush.

By this means a double reduction in the output rotational speed of the impeller is obtained, and besides rotating at a speed sufficient for the required wash action the rotating brush also has a torque sufficient to easily overcome the resistance which it encounters during its use.

Furthermore, the gear transmission is sufficiently isolated from the water flow, which does not oppose its operation.

All the objects of the invention are therefore attained.

The characteristics and constructional merits of the invention will be more apparent from the description of a preferred embodiment thereof given hereinafter by way of example.

Said figures show a cyathiform casing 1, to the mouth of which there is fixed in known manner a circular ring 2 carrying a fixed frustoconical brush 3 with its vertex situated in the direction of the roof of the casing 1.

Said fixed brush 3 surrounds a rotating brush 4 shaped as a frustoconical surface comprising a series of circumferentially equidistant sectors formed from bunches of bristles, and has its vertex in the direction of the bristle tips.

Figure 2:
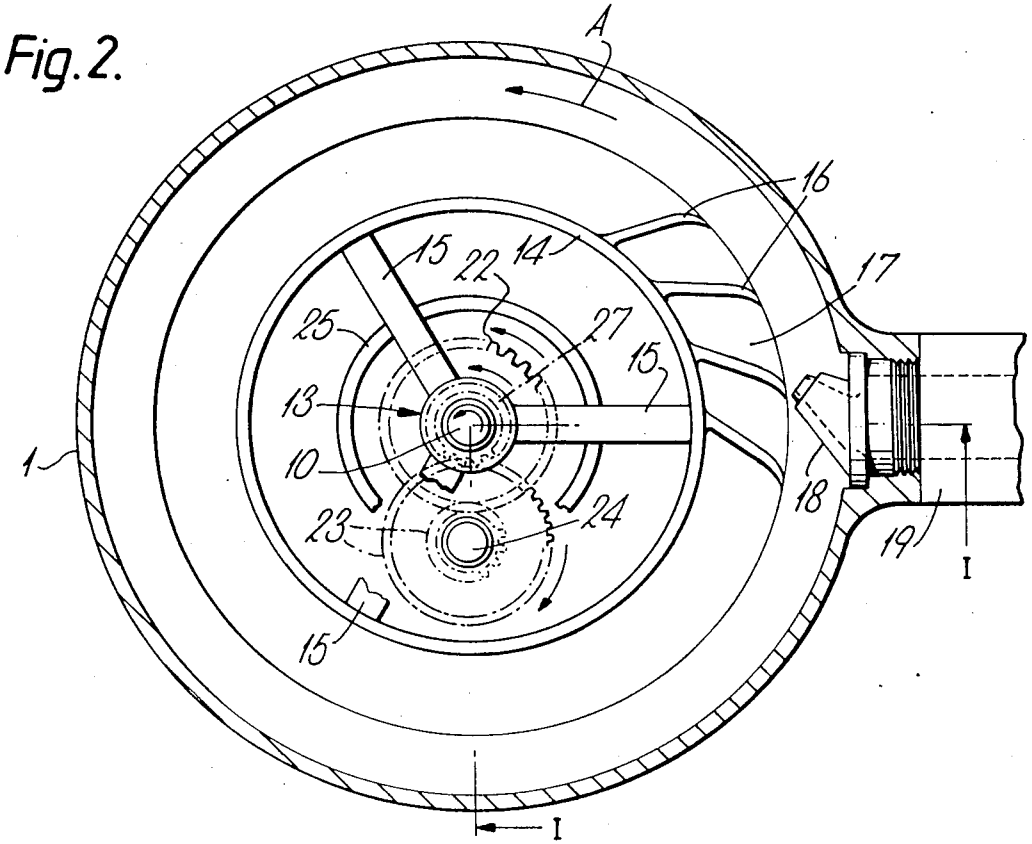
FIG. 2 is a section on the line II—II of FIG. 1.

Although not shown in detail, on the inside of the side wall of the casing 1 there are provided circumferentially equidistant helical ramps which wind in the same direction as the direction of rotation of the impeller, indicated by A in FIG. 2, said ramps having a width which gradually increases from the roof of the casing 1 to its mouth.

The ring 2 also comprises radial arms 5 converging into a central ring 6, and transversely having the same inclination in the same direction as said helical ramps.

The rotating brush 4 is also provided with spokes 7 which converge into a central support hub 8 and are transversely inclined in the oposite direction to the direction of inclination of said radial arms 5.

Said helical ramps and radial arms 5 act as elements for facilitating discharge of the wash water, whereas the spokes 7 act as water extraction members by putting the interior of the casing 1 under vacuum.

Figure 1:
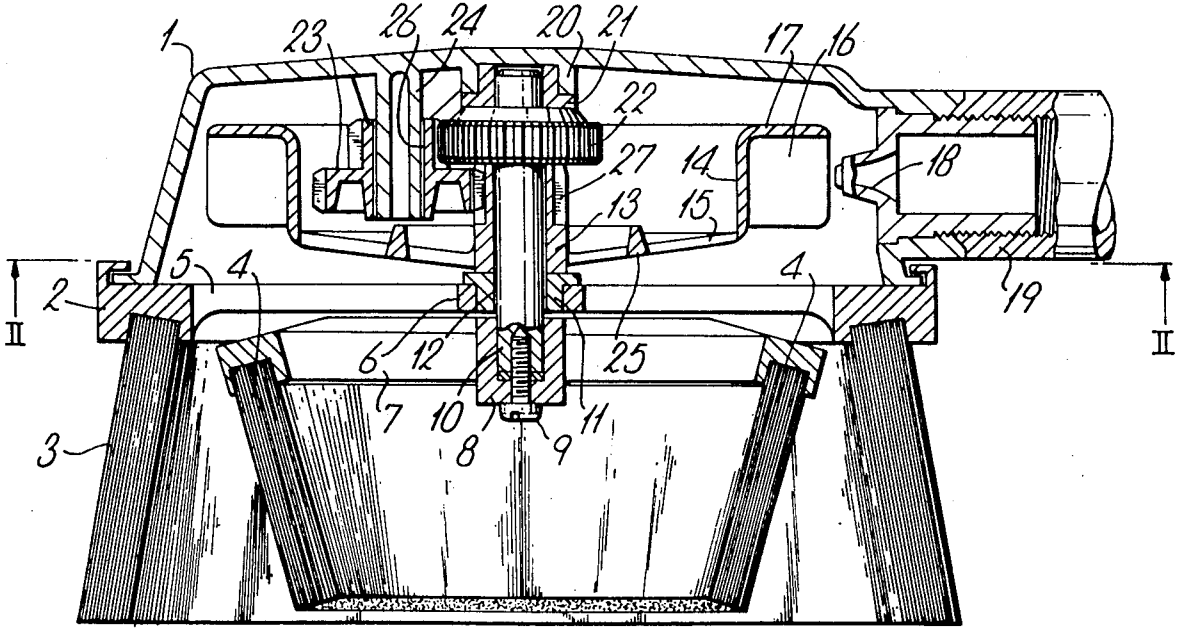
FIG. 1 is a section on the line I—I of FIG. 2.

As clearly shown in FIG. 1, said central hub 8 of the rotating brush 4 is fixed by a screw 9 to a shaft 10 which traverses the central ring 6 of the fixed brush 3 by was of a bush 11.

The shaft 10 is also rotatably mounted by way of a sleeve 12 through the hub 13 of a bladed impeller.

This latter consists of a cylindrical wall 14 supported by three spokes 15 connected to the said hub 13.

On the outside of the cylindrical wall 14 there is provided a series of equidistant chordal blades 16, which in the illustrated case are twenty in number and are inclined by substantially 18° to the radial direction.

On that side closer to the roof of the casing 1, the blades 16 are connected to a cantilever ledge 17 which projects from said cylindrical wall 14.

From the accompanying figures it can also be seen that tangentially to the bladed impeller 14–17 there is disposed a nozzle 18, which is fixed to the casing 1 by a grip 19 to be connected to a suitable wash water feed hose.

The roof of the casing 1 is centrally provided with a socket 20 which by way of a bush 21 receives that end of the shaft 10 distant from the end on which the rotating brush 4 is keyed.

A gear wheel 22 directly formed on said shaft 10 is interposed between the bush 21 and the hub 13 of the bladed impeller 14–17.

The gear wheel 22 permanently engages with that toothing of smaller pitch circle diameter of a double gear 23.

This latter is rotatably mounted by way of a sleeve 26 on a pivot 24 projecting from the roof of the casing 1, and is kept in position by a ring 25 which connects together the spokes 15 of the bladed impeller 14, 16.

In the illustrated embodiment the pitch circle diameter of the gear wheel 22 is double that of the smaller-diameter toothing of the double gear 23, and their meshing teeth are both of helical type.

That toothing of larger pitch circle diameter of said double gear 23 engages with toothing 27 provided on the hub 13 of the impeller 14, 16.

Of these two further toothings, the former has a pitch circle diameter double that of the latter, and both toothings are of the straight tooth type.

In this manner, two successive reductions are obtained, with the brush 4 rotating at a rotational speed equal to one quarter the rotational speed of the impeller 14, 16, with the initially stated advantages.

It should be noted that the brush 4 rotates in the same direction as the impeller 14, 16.

The use and operation of the invention are clearly apparent from the aforegoing description and from a simple examination of the accompanying figures.

The invention is not limited to the single embodiment heretofore described, and modifications and improvements can be made thereto but without leaving the scope of the inventive idea, the basic characteristics of which are summarised in the following claims.

We claim:

1. Apparatus for washing surfaces comprising, a pan-shaped casing having a closed top and an open bottom, a bladed impeller mounted for rotation within and generally coaxially of said casing, nozzle means converging into said casing for directing water generally tangentially of the bladed impeller to drive the impeller in rotation, said open bottom of the casing defining an outlet for the water from said nozzle so that the water flows along a flow path from the nozzle to the impeller and then through said outlet, said impeller having a body of cup shape which opens toward the closed top of the casing and defines with the top of the casing a region out of the flow path of the water flowing through the casing, a rotary brush adjacent said open bottom of the casing, a fixed brush connected to said casing and surrounding said rotary brush, reduction gear means connecting said impeller to said rotary brush for driving said brush in rotation at a speed less than the speed of rotation of the impeller, said reduction gear means being within said impeller body of cup shape in said region out of the flow path of water through the casing so that transmission of motion by the gears thereof is not opposed by the water flow.

2. Apparatus according to claim 1 wherein, said cup shaped body of said impellor comprises a cylindrical wall, a series of equally spaced chordal blades extending from said cylindrical wall, and a generally radial cantilever ledge extending from said cylindrical wall and between the top of the casing and the blades, said ledge covering the blades.

3. Apparatus according to claim 1 wherein, said rotary brush comprises a brush of frustoconical shape in which the bristles thereof are inclined inwardly from a supporting head thereof toward the free ends of the bristles.

4. Apparatus according to claim 3 wherein, said free ends of the bristles, when said brush is stationary, define a brush end of a diameter less than the diameter of the impeller.

* * * * *